US006149143A

United States Patent [19]

Richmond et al.

[11] Patent Number: 6,149,143

[45] Date of Patent: Nov. 21, 2000

[54] SPRING STRUCTURE FOR A MATTRESS INNERSPRING HAVING COAXIAL COIL UNITS

[75] Inventors: Darrell Richmond; Terry Aronson; Thomas J. Wells, all of Carthage; Franklin H. Rawlings, Diamond, all of Mo.

[73] Assignee: L&P Property Management Company, South Gate, Calif.

[21] Appl. No.: 09/189,232

[22] Filed: Nov. 10, 1998

Related U.S. Application Data

[63] Continuation-in-part of application No. 09/148,230, Sep. 4, 1998, abandoned, which is a continuation of application No. 08/612,490, Mar. 15, 1996, Pat. No. 5,803,440, which is a continuation-in-part of application No. 08/406,694, Mar. 20, 1995, Pat. No. 5,509,642.

[51] Int. Cl.[7] ..... F16F 3/04

[52] U.S. Cl. ..... 267/92

[58] Field of Search ..... 267/92, 103, 106, 267/107, 110; 5/247, 253, 255, 256, 257, 268, 475, 476

[56] References Cited

U.S. PATENT DOCUMENTS

| | | | |
|---|---|---|---|
| 653,155 | 7/1900 | Tilden . | |
| 822,654 | 6/1906 | Dawson . | |
| 837,751 | 12/1906 | Summers . | |
| 871,589 | 11/1907 | Hitchcock . | |
| 882,654 | 3/1908 | Smith . | |
| 1,192,510 | 7/1916 | Fischmann . | |
| 1,254,314 | 1/1918 | D'Arcy | 5/256 |
| 1,544,237 | 6/1925 | Karr | 5/256 |
| 1,925,868 | 9/1933 | Ehlenbeck et al. | 5/246 |
| 2,194,569 | 3/1940 | Rumpf . | |
| 2,241,039 | 5/1941 | Mattison | 5/351 |
| 2,265,426 | 12/1941 | Foster | 5/269 |
| 2,309,164 | 1/1943 | Burd | 5/248 |
| 2,567,520 | 9/1951 | McInerney et al. | 155/179 |
| 2,724,842 | 11/1955 | Rogovy | 5/248 |
| 2,781,083 | 2/1957 | Agrillo | 155/179 |
| 3,069,701 | 12/1962 | McInerney | 5/351 |
| 3,541,828 | 11/1970 | Norman | 72/140 |
| 3,657,749 | 4/1972 | Norman | 5/271 |
| 3,911,511 | 10/1975 | Higgins et al. | 5/255 |
| 4,034,429 | 7/1977 | Smith | 5/256 |
| 4,051,567 | 10/1977 | Hutchinson | 5/248 |
| 4,095,297 | 6/1978 | Thomas, Jr. | 5/256 |
| 4,112,726 | 9/1978 | Adams et al. | 72/137 |
| 4,358,097 | 11/1982 | Zapletal et al. | 267/101 |
| 4,488,712 | 12/1984 | Higgins | 267/91 |
| 4,619,445 | 10/1986 | Sasaki | 267/100 |
| 4,625,349 | 12/1986 | Higgins | 5/248 |
| 4,726,572 | 2/1988 | Flesher et al. | 5/256 X |
| 4,781,360 | 11/1988 | Ramsey | 5/248 X |
| 4,867,423 | 9/1989 | Marsh | 367/91 |
| 4,960,267 | 10/1990 | Scott | 267/91 |
| 5,052,064 | 10/1991 | Hagemeister et al. | 5/246 |
| 5,188,344 | 2/1993 | Dabney | 267/103 |
| 5,395,097 | 3/1995 | Dabney et al. | 267/103 |
| 5,509,642 | 4/1996 | Wells | 267/92 |
| 5,787,532 | 8/1998 | Langer et al. | 5/717 |
| 5,803,440 | 9/1998 | Wells | 267/92 |

FOREIGN PATENT DOCUMENTS

| | | |
|---|---|---|
| 756477 | 4/1967 | Canada . |
| 20583 | 6/1911 | United Kingdom . |
| 218194 | 7/1924 | United Kingdom . |

*Primary Examiner*—Christopher P. Schwartz
*Attorney, Agent, or Firm*—Wood, Herron & Evans, LLP

[57] ABSTRACT

An innerspring structure for a mattress comprises a row of outer coils formed from a continuous piece of wire with the coils interconnected with interconnection segments and a row of inner coils similarly formed. The interconnection segments of the coils form coil heads for pairs of adjacent coils and each head includes a first linear portion disposed generally parallel to the row. The row of inner coils is positioned together and generally coaxially with the row of outer coils for forming reinforced coil units. A helical lacing structure winds around portions of the inner and outer coils to couple the coils together into reinforced coil units and the first linear portions of the coils are configured for being captured with at least approximately three loops of the helical lacing structure for forming a row of reinforced coil units.

17 Claims, 5 Drawing Sheets

SPRING STRUCTURE FOR A MATTRESS INNERSPRING HAVING COAXIAL COIL UNITS

CROSS REFERENCE TO RELATED APPLICATIONS

This application is a continuation-in-part application of an application filed Sep. 4, 1998, entitled "Mattress Innerspring Structure Having Coaxial Coil Units, Ser. No. 09/148,230 now abandoned, which application is a continuation of application U.S. Ser. No. 08/612,490, entitled "Mattress Innerspring Structure Having Coaxial Coil Units" filed on Mar. 15, 1996 now U.S. Pat. No. 5,803,440, which application is a continuation-in-part application of application U.S. Ser. No. 08/406,694 entitled Mattress Innerspring Structure Having Coaxial Coil Units, filed Mar. 20, 1995, now U.S. Pat. No. 5,509,642, which applications and U.S. patents are all completely incorporated herein by reference in their entireties.

FIELD OF THE INVENTION

This invention relates generally to mattress innerspring structures and specifically to an improved innerspring structure having sections of enhanced firmness.

BACKGROUND OF THE INVENTION

Conventionally, mattress innerspring structures comprise a plurality of coil springs or coils which are positioned adjacent one another to extend between top and bottom face surfaces of a mattress. The coils are usually arranged in rows which determine the length and width of the innerspring structure. When individual coil springs or coils are used, they are held together by various means to form a unitary innerspring structure. Alternatively, a row of coils may be formed from a single continuous piece of wire wherein each of the single coils are connected in the row by interconnecting segments. The rows are then fixed together to form the innerspring structure. Examples of such spring assemblies having rows formed of a continuous piece of wire are disclosed in U.S. Pat. Nos. 4,358,097, 4,488,712 and 3,911,511, which are commonly owned with the present application.

The coils in the innerspring structure are typically formed very similar to each other, having generally the same coil diameter and similar stiffness, as dictated by the gauge of wire used to make the coils and the number of turns or pitch of each coil. Therefore, the top surface of a typical mattress will have generally equal firmness throughout the length and width of the mattress made from such an innerspring structure.

However, it is often desirable to make certain areas on the mattress more firm than other areas of the mattress. For example, it may be desirable to firm up the center section of the mattress which receives a majority of the weight from a person lying thereon. Further, it may be desirable to make the edge of a mattress more firm or durable to withstand pressures created when a person sits on the end of their bed.

Varying the stiffness of individual coils, such as by using different wire gauges and/or different numbers of coil turns, it might be possible to change the firmness in certain areas of an innerspring. However, as may be appreciated, such an undertaking would require constant conversion of the coil forming machine, and thus would result in a substantial cost increase attributable to both labor for the machine conversion and the delay in forming the innerspring structures.

Furthermore, the availability of various different wire materials and gauges for forming different coils for a single innerspring structure would have to be coordinated. Therefore, such an approach is impractical from a cost standpoint.

It is also desirable to vary the firmness in certain areas of an innerspring structure which utilizes continuous coil spring units. Such continuous coil spring products have met with considerable commercial success, primarily because considerably less material is required for the same degree of firmness in such a spring product than has been employed in spring assemblies which utilize rows of interconnected individual coil springs. However, the spring products made from these continuous coil springs have been found to be difficult or very expensive to modify in order to obtain sections of the product which are more firm than other sections of the same spring product. Varying the wire gauge or coil turns of a particular coil or coils in the product is not a practical option, because all coils are formed of a continuous piece of wire. Furthermore, breaking a particular continuous row of coils into discontinuous sections would destroy many of the benefits of the continuous coil spring product.

Solutions to the aforementioned problems are disclosed in U.S. Pat. Nos. 5,509,642 and 5,803,440, in the form of reinforced coaxial coil units joined together within an innerspring structure to reinforce certain areas in the innerspring. Such a structure may be utilized with individual coils or continuous coil units wherein the coils are formed from a continuous strand of wire.

It is one objective of the present invention to improve upon the existing technology as described above.

To that end, it is another objective of the present invention to make such improvements in the manufacturing of innerspring structures utilizing reinforced coil units.

it is also an objective of the present invention to increase the firmness in selected areas of a mattress, and to increase the durability of selected areas on a mattress which receive a high amount of loading during normal usage.

Furthermore, it is an objective of the invention to provide an innerspring structure at a relatively low cost and with a relatively uncomplicated design.

It is still another objective to provide a continuous coil innerspring product and a method for constructing same which will not require substantial variations in the assembly process in order to form sections of the product with varying firmness.

The above and other objects and advantages of the present invention shall be made apparent from the accompanying drawings and the description thereof.

SUMMARY OF THE INVENTION

The above objectives are addressed by a spring structure in accordance with the principles of the present invention which may be utilized within an innerspring structure. The spring structure comprises adjacent coils formed from a continuous piece of wire wherein interconnection segments connect the coils together at the ends or heads of the respective coils. Preferably, an entire row of coils is formed from a continuous piece of wire wherein adjacent coils of the row are connected together by interconnection segments.

The interconnection segments form coil heads for pairs of adjacent coils and each head includes a first linear portion. A coil will be coupled to an adjacent coil on one side by the segments at one head of the coil and to the other adjacent coil by a segment at an opposite head of a coil. That is, each coil will essentially be shared in two pairs of coils. The first linear portions of the heads of the coils of a pair are disposed generally parallel to each other on opposite sides of the coils in the pair. With respect to a row of coils, the first linear portions of the interconnection segments between adjacent coils are positioned on opposite sides of the row. The first linear portions of the coils are positioned radially outwardly from the main coil axis and are configured for being captured by securing structures so that the coils may be secured within an innerspring structure. In one embodiment of the invention, the securing structures include helical lacing structures which wind around portions of the coil heads. In a preferred embodiment, the first linear portion of each coil is configured to be captured with at least approximately three loops of the helical lacing structure.

Each interconnection segment connects a pair of adjacent coils and forms a pair of coil heads, and each interconnection segment further comprises a spanning portion which extends between the first linear portions of a pair of adjacent coils. The spanning portion couples the first linear portions of the coil pair together. In a preferred embodiment, the spanning portion extends generally perpendicular to the first linear portions. The interconnection segments further comprise second linear portions disposed opposite said first linear portions in the heads of the coil. The second linear portions are radially inset in the coil head with respect to the first linear portions and remain uncoupled from the securing structure, such as a helical lacing structure when the springs are built into an innerspring structure. As a result, each coil secured together within an innerspring structure is secured within the innerspring structure proximate only the first linear portion and therefore only one side of the coil. Since the first linear portions are positioned on opposite sides of the coil heads, adjacent coils are captured by a securing structure, such as the helical lacing structure, on opposite sides. When adjacent coils are incorporated within a row of coils, the coils of a pair are captured on opposite sides of the row of coils.

In accordance with another aspect of the present invention, the inventive spring structure may be utilized within an innerspring structure for forming a row of reinforced coil units. A row of outer coils is formed from a continuous piece of wire with adjacent coils of the row interconnected with interconnection segments. A row of inner coils is also formed from a continuous piece of wire with adjacent coils interconnected with interconnection segments. The interconnection segments of the rows form coil heads with each head including a first linear portion disposed generally parallel to the row, as discussed above. The row of inner coils are positioned together and generally coaxially with the row of outer coils to form reinforced coil units. The first and second linear portions of the coil overlap in the heads of the reinforced coil units. A securing structure couples to the first linear portions of the coils for securing the inner and outer coils together to form a row of reinforced coil units. The row of reinforced coil units is then incorporated within an innerspring structure with other coil rows, utilizing securing structures such as helical lacing structures to couple the rows together.

In accordance with another aspect of the present invention, the second linear portions of each coil head are positioned slightly vertically below the respective first linear portions of that coil head. In that way, the rows of inner and outer coils may be positioned together easily to form the reinforced coil units without the heads of one row of coil units interfering with the body of the other coil units. In that way, the rows of inner and outer coils may be easily slid together and secured together, such as with the helical lacing structures.

In accordance with another aspect of the present invention, adjacent coils formed in a row will include an end coil having an end head. A portion of the interconnection segment opposite a first linear portion in the head includes a nipple which is formed to extend radially outwardly from the main axis of the end coil body. The nipple is configured to be captured by the helical lacing structure for securing the end coil at two sides of the end head. That is, the end coil is secured in the head of the coil at its first linear portion and is also secured at the nipple opposite the first linear portion. In that way, the end coils are secured at two sides of an innerspring structure for more firm support at the ends of the rows which will generally be positioned around the periphery of an innerspring structure.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
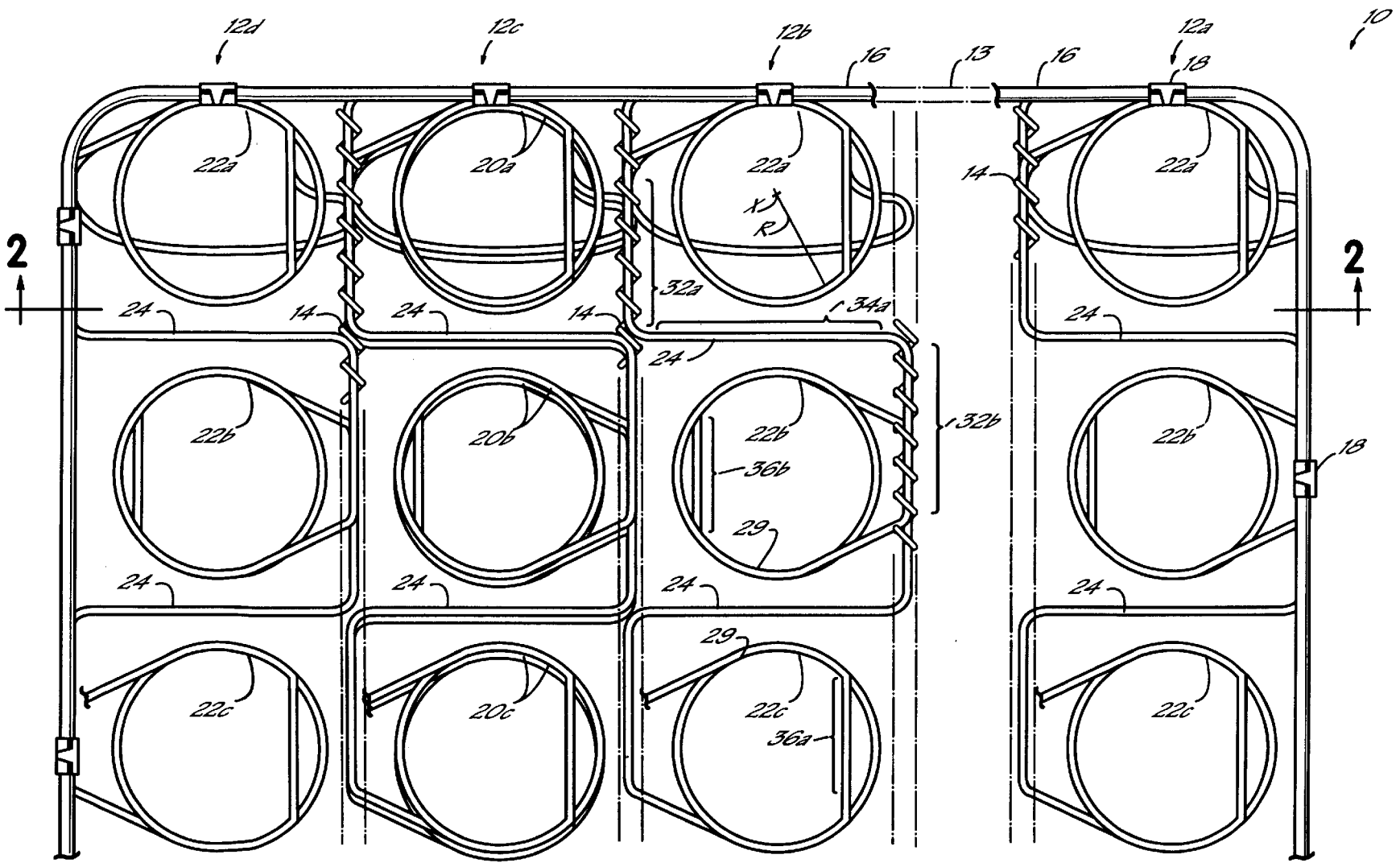
FIG. 1 is a top view of a portion of the innerspring structure of the present invention utilizing reinforced coil units laced together by helical lacing structures.

FIG. 1 illustrates the top view of an innerspring structure 10 utilizing inventive spring structures in accordance with the principles of the present invention. The innerspring structure 10 utilizes coils and reinforced coil units laced together by helical lacing structures 14. The innerspring structure 10 includes individual rows 12*a*, 12*b*, 12*c*, 12*d* of coils. As indicated by the dashed lines 13 in FIG. 1, any number of coil rows might be utilized in innerspring structure 10 beyond the four rows illustrated in FIG. 1. The coil rows 12*a*–12*d* are positioned next to each other in structure 10, with each row generally parallel to an adjacent row. The coil rows are coupled together with appropriate securing structures, such as helical lacing structures 14, to form the innerspring structure 10. Other securing structures might be utilized to secure the coil rows together besides the helical lacing structures 14 shown in the Figures. A border wire 16, which will generally be thicker, and therefore stronger, than the wires utilized to form the coil rows 12*a*–12*d*, is coupled to the rows of coils around the periphery of the innerspring structure utilizing fasteners such as clips 18 to form the border of the innerspring structure 10.

In accordance with one principle of the present invention, a row of outer coils and a row of inner coils are positioned together to form reinforced coil units 20 illustrated within row 12*c* of FIG. 1, and discussed further hereinbelow.

Figure 2:
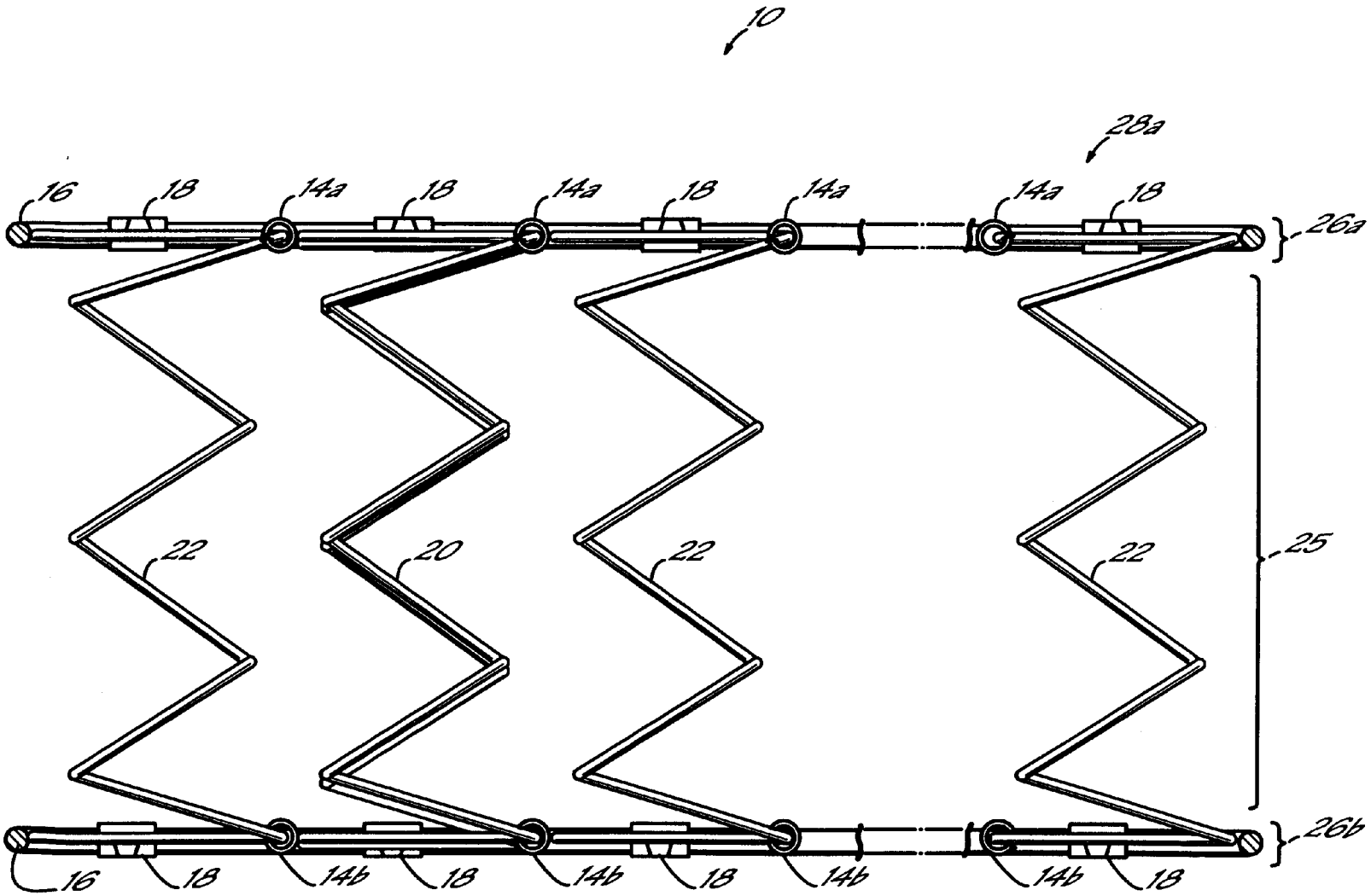
FIG. 2 is cross-sectional view taken on lines 2—2 of the innerspring structure of FIG. 1.

In one embodiment of the invention, coil springs making up the coil rows 12*a*–12*d* are formed from a continuous piece of wire wherein adjacent coils are interconnected together in the row with interconnection segments. That is, a single piece of wire forms all of the coils of a row and connects the coils of the row together. More specifically, referring to row 12*b* in FIG. 1, each individual coil 22*a*, 22*b*, 22*c* is positioned adjacent to another coil in the row and the individual coils are connected together by interconnection segments 24 in top or bottom face surfaces of the innerspring structure 10. Referring to FIG. 2, each coil 22 includes a coil body 25 and coil heads 26*a*, 26*b*. Coil body 25 extends between the heads, and the heads are positioned respectively in the top face surface 28*a* and bottom face surface 28*b* of the innerspring structure 10. Herein, the heads will refer to those portions of each individual coil 22 which interface with and form the top and bottom face surfaces 28*a*, 28*b* of the innerspring structure. The rest of the coil spanning between the heads is referred to as body 25. As will be appreciated, with spring structures the delineation between the heads of a coil 26*a*, 26*b* and the body 25 are not always definite. Generally, the head of the coil will be referred to as that portion of the coil at the end of the coil body which is generally parallel with the defined top and bottom face surfaces 28*a*, 28*b* of the innerspring structure 10 into which the coil is integrated.

In the embodiment of the invention illustrated in the figures, the interconnection segments 24 which couple the coils 22 together also form coil heads 26*a*, 26*b* for pairs of adjacent coils. The interconnection segments 24 either form coil heads in an upper face surface 28*a* or a lower face surface 28*b*. That is, the coils 22 formed from a continuous piece of wire are connected to adjacent coils by interconnection segments in either the top or bottom face surfaces 28*a*, 28*b* and the interconnection segments 24 will be staggered between adjacent coils. Referring to FIG. 1, if coil 22*a* is coupled to coil 22*b* by an interconnection segment 24 positioned in an upper face surface 26*a* of the innerspring structure, then the coil 22*b* will also be coupled to the adjacent coil 22*c* by an interconnection segment 24 located in the bottom face surface 28*b* of the innerspring structure. In that way, one head of each coil will be formed by an interconnection segment 24 in the top face surface 28*a* of the innerspring structure and the other head will be formed by an interconnection segment 24 in the bottom face surface 28*b* of the innerspring structure. Coil 22*b* will be connected to coil 22*a* by one interconnection segment 24 and will be connected to coil 22*c* by another, different, interconnection segment.

Figure 3:
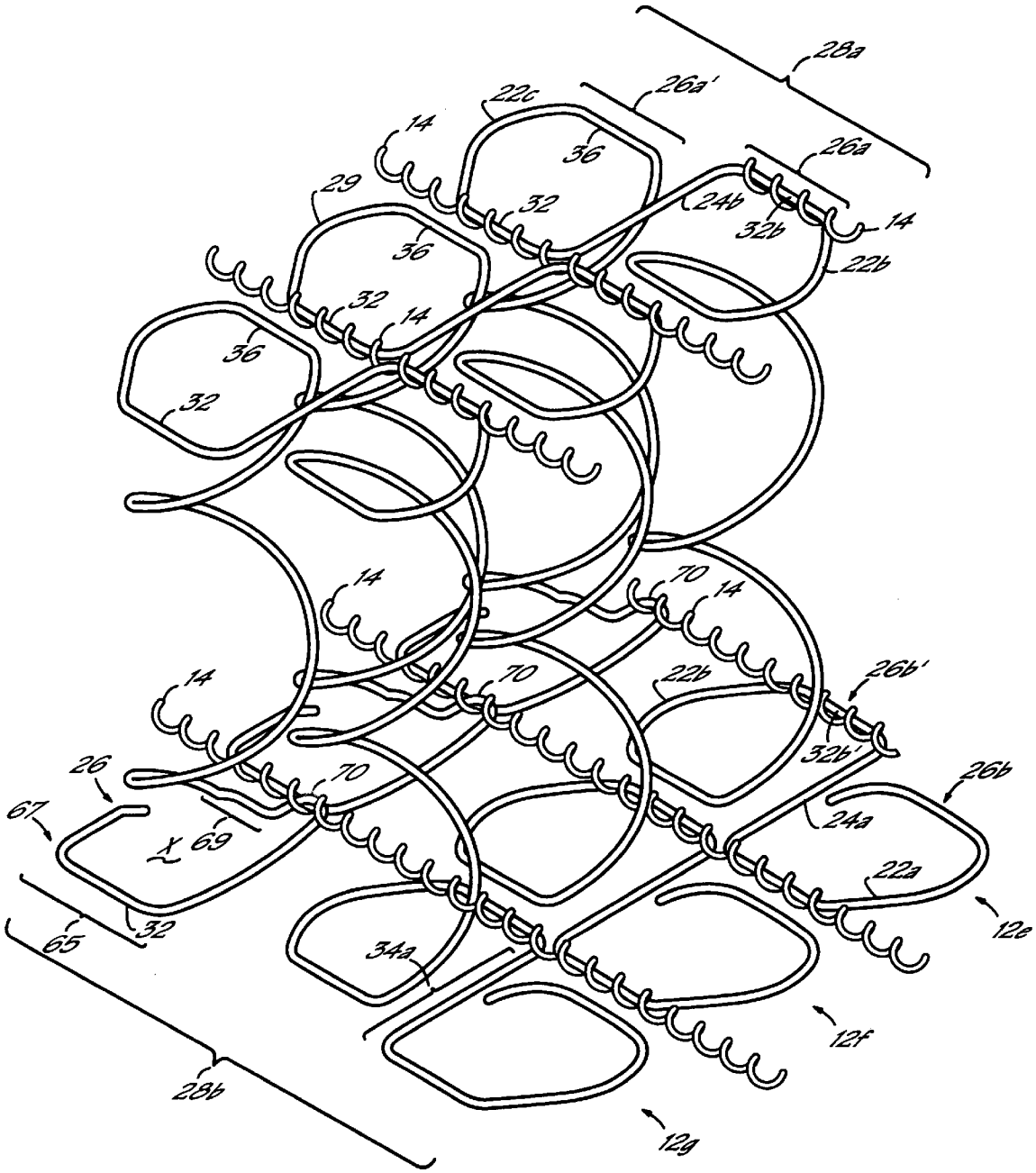
FIG. 3 is a perspective view of continuous spring structures of the invention formed into a section of an innerspring structure.

Referring to FIG. 3, portions of coil rows 12*e*, 12*f*, 12*g* are illustrated to illustrate the staggered interconnection segments 24 forming the heads of the coil. Specifically, referring to row 12*e*, head 26*b* of coil 22*a* is formed by interconnection segment 24*a* to couple coil 22*a* to adjacent coil 22*b*. Interconnection segment 24*a* also forms the head 26*b*' of coil 22*b* within a bottom face surface 28*b* of the innerspring structure 10. Coil 22*b* extends from the head 26*b*' up to the top face surface 28*a* of the innerspring structure wherein another interconnection segment 24*b* couples coil 22*b* to coil 22*c*. Again, the interconnection segment 24*b* in the upper face surface 28*a* forms an upper head 26*a* for coil 22*b* and an upper head 26*a*' of coil 22*c*. Referring to FIG. 3, helical lacing structures 14, such as helical lacing wires, are wound around portions of the heads and interconnection segments of the coils of adjacent coil rows to couple the rows together. For example, row 12*e* is coupled to row 12*f* and row 12*f* is coupled to row 12*g* by the helical lacing structures 14 in the top and bottom face surfaces 28*a*, 28*b*.

The rows of coils in the innerspring structure, for example, rows 12*a*–12*d* in FIG. 1, are held or laced together by helical lacing structures 14. More specifically, referring to FIG. 1, a plurality of spaced-apart helical lacing structures 14 extend generally parallel to the aligned coil rows 12. The helical lacing structures 14 connect the coil rows with adjacent coil rows. Helical lacing structures extend the length or width of the innerspring structure 10, depending upon how the rows 12 are oriented within structure 10, and the helical lacing structures wrap the respective heads 26*a*, 26*b* of the adjacent coils proximate the face surfaces 28*a*, 28*b* respectively, of the innerspring structure. Furthermore, when a row of inner coils and a row of outer coils are coupled together to form reinforced coil units 20, the helical lacing structures 14 also connect the heads of the inner and outer coils together to form generally unitary reinforced coil units (see FIGS. 4A and 4B).

In accordance with another aspect of the present invention, the interconnection segments 24, which form the coil heads 26*a*, 26*b* for the pairs of adjacent coils, are configured in shapes such that each head includes a plurality of linear portions which are connected by spanning portions which extend between the specific linear portions to couple the linear portions together. The spanning portion extends generally perpendicular to the linear portions. Specifically, referring to FIG. 1 and row 12*b* therein, the interconnection segment 24 couples coil 22*a* with coil 22*b*. The interconnection segment 24 forms upper or top coil heads for the adjacent coils 22*a*, 22*b* and each head formed by the interconnection segment 24 includes a first linear portion 32*a*, 32*b* respectively. The first linear portions 32*a*, 32*b* are coupled together by a spanning portion 34*a* which is part of the interconnection segment 24 and connects the first linear portions 32*a*, 32*b* together In a preferred embodiment of the invention, the spanning portion 34*a* extends generally perpendicular to the first linear portions 32*a*, 32*b*, although there may be a slight angling of the spanning portion 34 between the linear portions 32*a*, 32*b* due to the imprecise formation of wires when making coils and innerspring structures in accordance with the principles of the invention. The spanning portion 34*a* is dimensioned and configured to position the first linear portions 32*a*, 32*b*, generally radially outside of the radius R of the respective bodies of the coils 22*a*, 22*b*. The linear portions 32*a*, 32*b* extend generally parallel to the row of coils 12*b* in which they are located. The respective first linear portions 32*a*, 32*b* of the adjacent coils 22*a*, 22*b* are spaced from the axes X of the coils and are preferably dimensioned such that the helical lacing structures 14 on either side of the row of coils 12*b* capture the first linear portions with at least approximately three (3) loops in a preferred embodiment of the invention. In an alternative embodiment of the invention, the respective linear portions 32*a*, 32*b* of the interconnection segment 24 coupling adjacent coils together might be configured and dimensioned to be captured by a greater or lesser number of helical loops than 3 loops. However, it has been determined that 3 loop lacing between the various first linear portions and the adjacent rows of coils is sufficient to provide a strong and durable innerspring structure 10 and to secure the rows 12 together as well as form reinforced coil units 20.

As illustrated in FIG. 1, each coil head formed by an interconnection segment, such as interconnection segment 24, includes a respective first linear portion corresponding to a coil of the pair of adjacent coils which are coupled together by interconnection segment 24. That is, the head for coil 22*a* includes first linear portion 32*a* and the head for coil 22*b* includes first linear portion 32*b*. The spanning portion 34*a* is shared by the heads of coils 22*a*, 22*b*.

The interconnection segments also comprise second linear portions 36*a*, 36*b* which are disposed opposite the first linear portions 32*a*, 32*b* in the coil heads. The second linear portions 36*a*, 36*b* are configured to be generally radially inside of the radius R of the coils and thus remain uncoupled from the helical lacing structures 14. More specifically, turning again to the coils of row 12*b* in FIG. 1, a second linear portion 36*a* is positioned opposite the first linear portion 32*a* in the head of coil 22*a*. A second linear portion 36*b* is positioned opposite the first linear portion 32*b* in coil 22*b*. Therefore, each coil head includes first and second linear portions 32*a*, 36*a* which extend generally parallel to each other and generally parallel to the row of coils 12*b*. The first linear portions 32*a*, 32*b*, discussed above, are positioned radially outside of the radius R of the coils, and thus are engaged by the helical lacing structures 14. The second linear portions 36*a*, 36*b* are positioned radially inside the radius R of the coil and are not captured by the helical lacing structures 14. The interconnection segments between adjacent coils form the linear portions of the coils.

As seen in FIG. 3, the interconnection segments 24 include curved portions 29 which extend between the first linear portions 32 and the second linear portions 36 opposite the spanning portions 34. That is, the first linear portions 32 of adjacent coils are coupled together by spanning portion 32 of the interconnection segment 24 while the first linear portions 32 are coupled to their respective second linear portions by a curved portion 29 of the interconnection segment. A segment of curved portion 29 will generally follow the curvature of the turns of the coil bodies as shown in FIG. 1.

As will be readily understood, formation of wires to form coils generally and the inventive coils 22 specifically, is not a precise art. Therefore, reference to first linear portions 32 and second linear portions 36 refers to the fact that those portions 32, 36 are generally linear as opposed to the curved turns of the coil body which winds between the face surfaces 28*a*, 28*b*. Therefore, the linear portions 32, 36 of the invention do not have to be perfectly linear and may even have some slight curvature. Any slight curvature will generally be less than the curvature or radius of the turns in the rest of the coil body.

In accordance with another aspect of the present invention, the first linear portions 32*a*, 32*b* are positioned on opposite sides of the coil heads of the adjacent coils 22*a*, 22*b* such that each coil 22*a*, 22*b* of the pair of adjacent coils is captured by the helical lacing structure 14 on opposite sides of the row of coils. Referring to FIG. 1, the first linear portion 32*a* of coil 22*a* is captured by helical lacing structure 14 on the left side of coil row 12*b*, while the first linear portion 32*b* of coil 22*b* is captured by helical lacing structure 14 on the right side of coil row 12*b*. Similarly, the second linear portions 36*a* and 36*b* are also positioned on opposite sides of the coil row 12*b*. As mentioned, the second linear portions 36*a*, 36*b* are formed in the head of the coils, and since those heads are located proximate the top and bottom face surfaces 28*a*, 28*b* of the innerspring structure, the second linear portions 36*a*, 36*b* ensure that the coil turns proximate the heads of the coils do not interfere with the helical lacing structures 14. As illustrated in FIG. 1, above and below the respective second linear portions of a coil, the coils, and specifically the coil turns of the bodies 25, assume a generally circular shape throughout the rest of the body 25 to form a generally cylindrical coil body. As illustrated in FIG. 3, the top head 26*a* and bottom head 26*b* of an individual coil 22*b* will generally be secured on the same side of the top and bottom face surfaces 28*a*, 28*b* of the innerspring structure. That is, the first linear portions 32*b* and 32*b*' on opposite heads of the coil 22*b* are located on the same side of the coil 22*b* and thus are captured by the helical lacing structure on the same side. (See FIG. 3.)

In accordance with another aspect of the present invention, rows of coils may be positioned together to form reinforced coil units 20, as illustrated in row 12*c* of FIG. 1. To that end, individual rows of coils may be positioned together with each of the coils oriented coaxially with another coil to form a row of reinforced coil units 20.

Certain areas of the innerspring structure 10, and specifically certain coil rows of the innerspring structure, such as row 12*c* (see FIG. 1) are made more firm than other coil rows, such as rows 12*d*, 12*b*, by utilizing reinforced coil units 20 formed by placing one row of coils within another row of coils. Specifically, one row of coils, referred to as inner coils, and another row of coils, referred to as outer coils, might be positioned side-by-side and pushed together at their sides to form an inner mesh coil unit. The rows of inner and outer coils are positioned together such that the individual coils of the rows are generally coaxial with each other, and thereby form reinforced coil units 20 or, rather, a row of reinforced coil units.

Figure 4A:
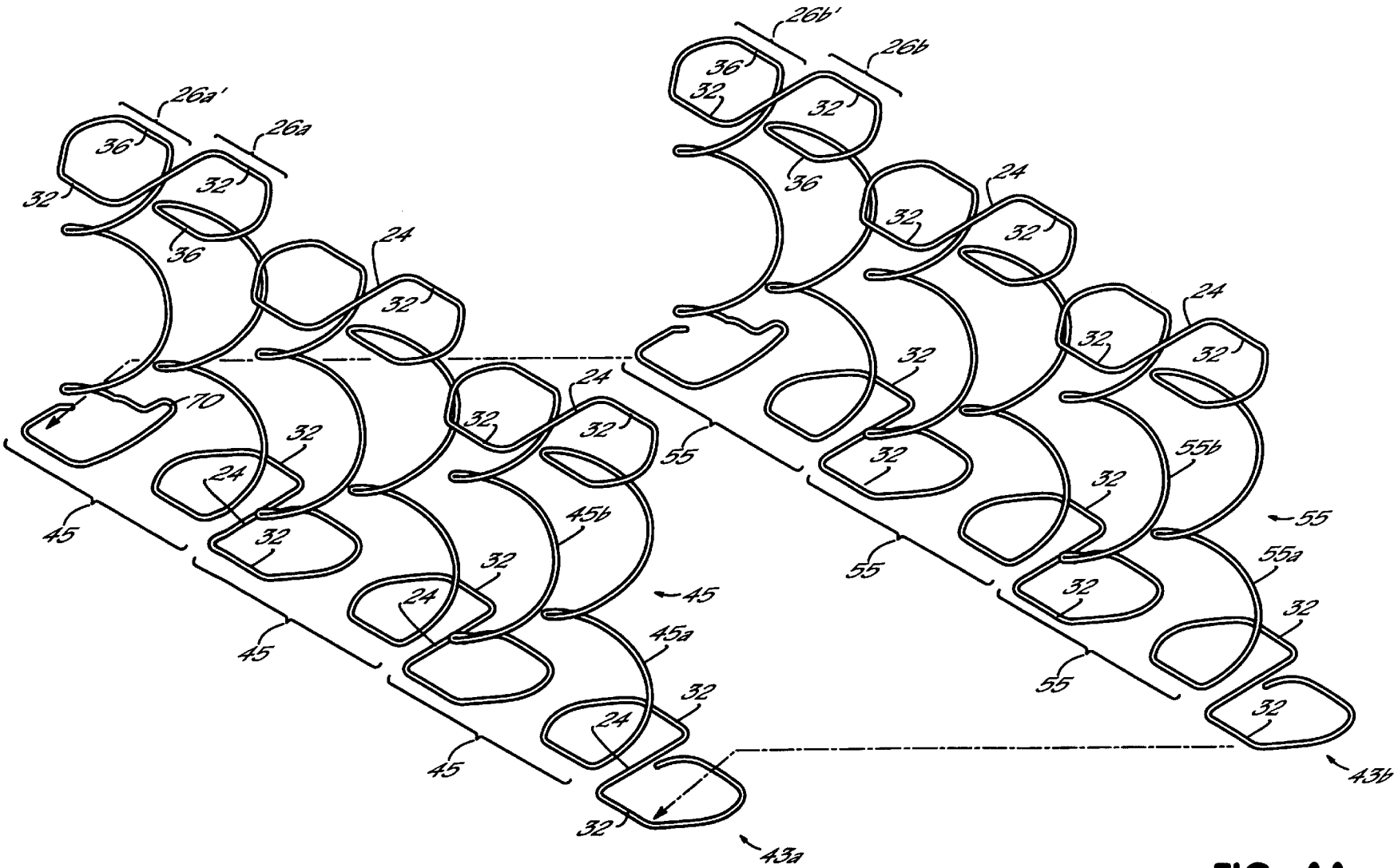
FIG. 4A is another perspective view of continuous spring structures in accordance with the principles of the invention.
Figure 4B:
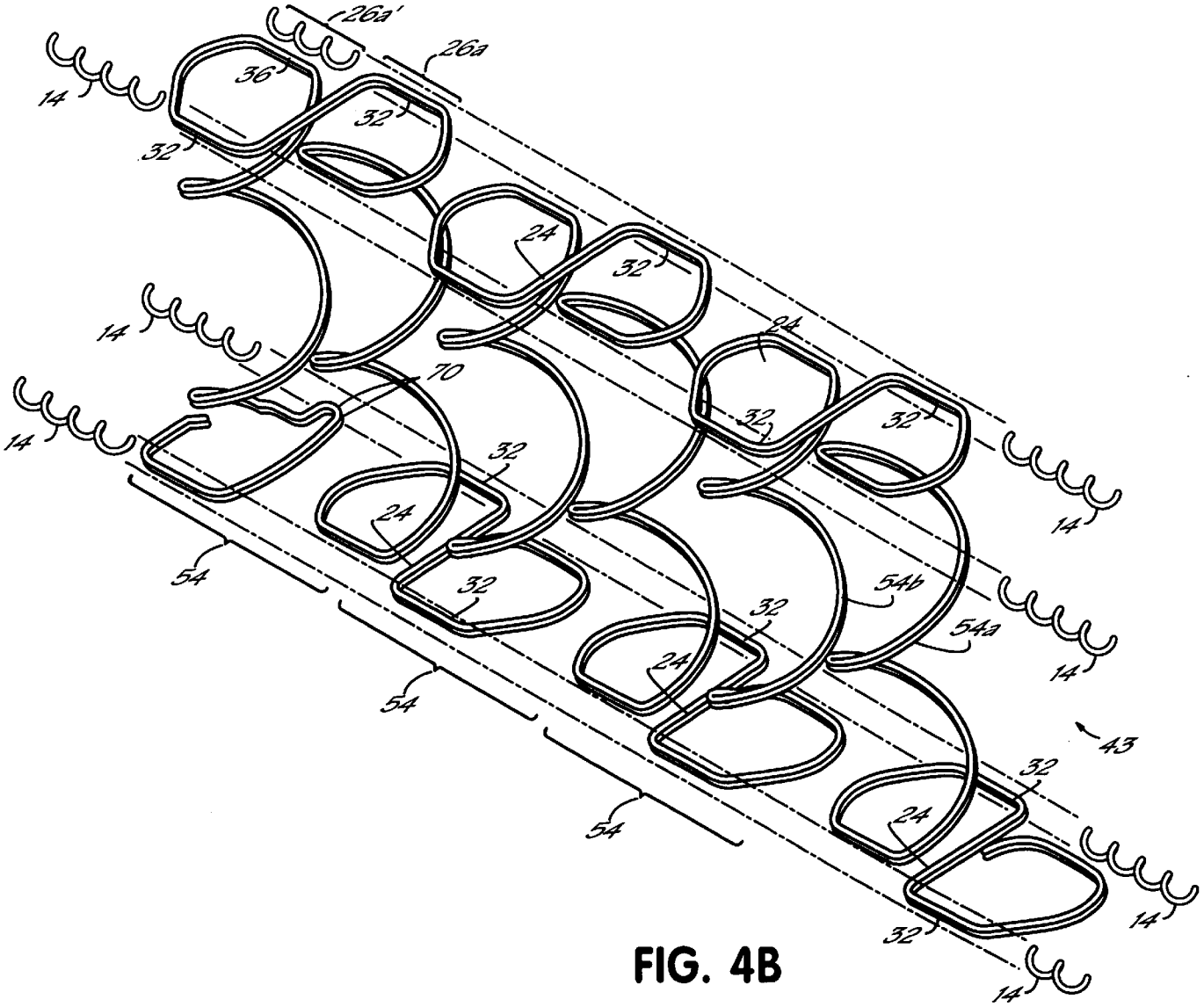
FIG. 4B is a perspective view of the continuous spring structures of FIG. 4A positioned to intermesh to form reinforced coaxial coil units.

Referring to FIGS. 4A and 4B, the inner coils would generally be wound in the same direction as the outer coils for being positioned together to form the row of reinforced coil units 20. The inner and outer coils of the rows are effectively nested together and the individual coils 22 extend generally coaxially one with the other such that coil turns of each coil body 25 remain generally adjacent to each other in the mattress and are flexed simultaneously when a load is applied to the face surfaces 28*a*, 28*b* of the structure 10. Corresponding orientation of adjacent turns of the coils change with respect to each other such that one coil turn may be inside of or outside of the other turn, regardless of whether the coil is designated as an "inner" or "outer" coil. That is, the terms, inner and outer coil, are for reference only and might be used alternatively to describe the same coil structure. That is, the terms "inner" and "outer" are used merely for illustrative purposes, and do not necessarily denote the position of individual coils in a reinforced coil unit.

As best illustrated in FIGS. 4A and 4B, each coil pair 45 or reinforced coil unit pair 54 comprises a first right handed coil 45*a* or coil unit 54*a* offset from a second right handed coil 45*b* or coil unit 54*b*, preferably having the same number of turns, and the same pitch, as coil 45*a* or coil unit 54*a*. Of course, the coils or coil units might also be left handed coils as long as each coil in an adjacent row can mesh with the coils of another row to form reinforced coil units. The coaxial coil units 54*a*, 54*b* of row 43 are formed in accordance with the principles of the invention by positioning together a row of inner coils, such as coils 45*a*, 45*b* and a row of outer coils designated 55*a*, 55*b* (see FIG. 4A). As discussed above, the reference to "inner" and "outer" coils is for reference purposes only. Preferably, the inner coils 45*a*, 45*b* will generally be identical to the outer coils 55*a*, 55*b* so that the two rows of inner and outer coils may be easily positioned together to form a row of coaxial coil units 54*a*, 54*b* as discussed further hereinbelow (see FIG. 4B).

Referring to FIG. 1, the innerspring structure 10 of the invention will include rows of coils 12*a*–12*d*, wherein preferably at least one of the rows, e.g., 12*c*, includes a reinforced coaxial coil unit 20 or 54*a*, 54*b* for making one or more sections of the innerspring structure 10 more firm than other sections of the structure. of course, the unique coil spring 22 of the invention may be incorporated into an innerspring structure as only single coil rows. Generally, an entire row would be either single coils 45 or coaxial coil units 54, but partial rows of coaxial coil units and single coaxial units may be used, if desired. While FIGS. 4A and 4B show a single row for illustrative purposes, it should be understood that a plurality of adjacent rows like row 43 might be utilized. Furthermore, all of the rows, whether single coils or reinforced coaxial coil units, are preferably positioned and secured in a similar fashion.

FIG. 4B illustrates a row of coaxial coil units constructed in accordance with the principles of the present invention. Specifically, row 43 comprises a plurality of adjacent reinforced coaxial coil unit pairs 54 comprising reinforced coil units 54*a*, 54*b*, which are made up of inner coil pairs 45, comprising inner coils 45*a* and 45*b* as well as outer coil pairs 55, including individual outer coils 55*a* and 55*b* (See FIG. 4A). That is, each coaxial coil unit, e.g., 54*a*, will comprise an inner coil 45*a*, and an outer coil 55*a*. As mentioned, in a preferred embodiment, the inner and outer coils 45*a*, 55*a* will generally have the same shape and will generally be interchangeable.

Referring to FIG. 4A, row 43 of reinforced coaxial coil units 54 is formed by positioning or intermeshing a row of outer coils 55*a*, 55*b*, with a row of inner coils 45*a*, 45*b*. For example, a first row 43*a* of inner coils 45*a*, 45*b* might be positioned as a row of the innerspring structure 10. Next, a row 43*b* of outer coils 55*a*, 55*b* is positioned adjacent to the row 43*a* of inner coils 45*a*, 45*b* to extend generally parallel thereto such that the inner coil pairs 45 are aligned with the outer coil pairs 55. Each row 43*a*, 43*b* is made of a continuous piece of wire so that the adjacent individual coils 45*a*, 45*b* and 55*a*, 55*b* are connected by interconnection segments 24. As mentioned, the row of outer coils 55*a*, 55*b* may be formed in the same way in which the row of inner coils 45*a*, 45*b* is formed, as the designation of inner and outer coils is made for the purpose of illustration. Preferably, the rows of inner coils 45*a*, 45*b* and outer coils 55*a*, 55*b* are positioned such that all the coils have the same winding direction as well as the same orientation of the interconnection segments 24. In that way, as illustrated in FIGS. 4A and 4B, when the adjacent rows 43*a*, 43*b* of coils are pushed together to form a row 43 of reinforced coil units 54 in accordance with the principles of the present invention, the individual rows 43*a*, 43*b* intermesh easily together so that at least one inner coil, e.g., 45*a*, of each reinforced coaxial coil unit 54*a* is wound or positioned coaxially with respect to an outer coil 55*a* of the coaxial coil unit.

Rows of reinforced coaxial coil units 54 might be utilized at the sides and around the periphery of the innerspring structure 40 to extend longitudinally and therearound for strengthening the mattress periphery, which receives a lot of pressure from persons sitting thereon. However, in a preferred embodiment, the rows 43 of coaxial coil units 54 are positioned to lie transverse in the innerspring structure 10 for forming firmer sections at different positions along the length of the innerspring structure 10 and along the length of a mattress formed from such an innerspring structure.

Preferably, each innerspring row 12*a*–12*d* would generally contain coils therein which are identical to every other coil in the row and of the same twist direction and pitch (turns per unit length). That is, each row is generally configured identical, except rows of coaxial coil units 54 will comprise two rows of inner and outer coils 45, 55 intermeshed together.

In order to connect together the adjacent rows of coils and reinforced coil units, the rows 12*a*–12*d* (FIG. 1) are first positioned so that the first linear portions 32 of the interconnection segments 24 which interconnect adjacent pairs of coils within each row, such as segment 24*b* for a pair of inner coils 45*a*, 45*b* or single coils, are aligned with the first linear portions 32 of the adjacent row of coils or coil units. These aligned first linear portions 32 are then connected or tied together by helical lacing structures 14. Referring to FIG. 2, a first set of helical lacing structures, herein designated 14*a*, is disposed within the top face surface or plane 28*a* of the innerspring structure 10 so as to join together rows of coils 22. Similarly, a second set of helical lacing structures, herein designated 14*b*, lie within the bottom face surface or plane 28*b* of the innerspring structure 10. As evident in FIGS. 4A and 4B, the length of each helical lacing structure is preferably approximately the same as the length of the rows, and the helical lacing structures 14 extend generally parallel to the rows. As illustrated in FIG. 1, the helical lacing structures 14 also connect together the row of reinforced coil units 20. In that way, the inner coils 45*a*, 45*b* are maintained generally coaxial and intermeshed with the outer coils 55*a*, 55*b* to collectively form the reinforced coaxial coil units 54*a*, 54*b* of the invention. (See FIG. 4A.)

The assembly of the helical lacing structures 14 to the rows of continuous coils may be accomplished on an assembly machine. In such a machine, the adjacent rows of coils are positioned so that the first linear portions 32 are aligned . A helical wire is then rotated or screwed onto the first linear portions. In forming a row of reinforced coaxial coil units 54 in accordance with the principles of the present invention, a row of inner coils 45*a*, 45*b* must be nested or positioned with a row of outer coils 55*a*, 55*b* before any helical lacing structures 14 are positioned over the overlapping first linear portions 32. After completion of the threading of a particular helical lacing structure onto the overlapped first linear portions 32, the now connected adjacent rows of coils and/or reinforced coaxial coil units are indexed forwardly and another pair of upper and lower helical lacing structures 14, are threaded over the next row of coils 45*a*, 45*b*, or the next row of reinforced coil units 54*a*, 54*b*, depending upon the construction of the next row. The process is repeated for the desired length or width of the mattress, row upon row, after which the innerspring structure is removed from the machine.

In accordance with another aspect of the present invention, the coils of the invention are formed to ensure proper positioning when coil rows 43*a* and 43*b* are positioned together to form the row 43 of reinforced coil units (see FIGS. 4A and 4B). Furthermore, in accordance with another aspect of the present invention, the end coils of each row are uniquely configured to be secured with a helical lacing structure 14.

First, referring to FIG. 4B, each interconnection segment 24 between the pairs of adjacent coils 45 is configured such that the first linear portion 32 is positioned slightly vertically above the second linear portion 36 with respect to a plane defined by a face surface of the innerspring structure. The first linear portion 32 will be only slightly above the second linear portion 36 such that, in general, the first and second linear portions still lie generally within a face surface 28*a*, 28*b* of the innerspring structure. When the individual coil rows 43*a*, 43*b* are oriented and positioned together, as shown in FIG. 4A, one head of the coil, such as head 26*a* within row 43*a* will fit generally above the head of its corresponding coil, such as head 26*b* within coil row 43*b*. At the same time, the head of the adjacent coil, such as head 26*a*', will fit also fit generally above the head of its corresponding coil, such as head 26*b*', within row 43*b*. The lower positioning of the second linear portion 36 will allow the respective first linear portions 32 of other coils to slide over the second linear portions 36 when rows 43*a* and 43*b* are positioned together. (See FIG. 4B.) In that way, the construction and turn direction of the individual coils, and particularly the bodies of the coils, will not interfere with each other or with the heads 26 of adjacent coils, and the rows of coils may be positioned easily together by directing one coil row against another, as illustrated in FIG. 4B. It should be understood that head 26*b*, 26*b*' may be positioned generally above the heads 26*a*, 26*a*' just as well if the positions or rows 43*c*, 43*b* were reversed when forming the reinforced coil row 43. As long as the first linear portions 32 pass over the second linear portions 36 of coils from an adjacent row, the two rows 43*a*, 43*b* will properly nest together.

Referring again to FIGS. 4A and 4B, if the second linear portions 36 are positioned above the first linear portions 32 when the rows are moved together, the coil turns of a body of one of the coils, such as coil 45*a*, would interfere with the first linear portion of a coil, such as coil 55*a*. In accordance with the principles of the invention, such interference is prevented. In an alternative positioning of the coils within a row of reinforced coil units, the heads of a coil pair in a row might be staggered, as long as the first linear portions of a row of coils slide over the second linear portions of the other row of coils. For example, referring to FIG. 3, heads 26*a*, 26*a*' may not both be above the heads 26*b*, 26*b*'.may not be above the heads 26*b*, 26*b*'. Rather, head 26*b*' might fit over head 26*a*' while head 26*a* fits over head 26*b*. The vice versa scenario is also possible. When heads are staggered in such a fashion, there will generally be a crossover in the wires forming the spanning portions 34, because one head of a coil will be generally on top in the reinforced coil unit pair, while the other head will be below in the other coil of the pair.

In accordance with another aspect of the present invention, the end coils of each row of coils are formed to include a nipple which extends outwardly from the axis of the coil and is configured to be captured by the helical lacing structure 14 for securing the end coil at two sides of the head of the end coil. Specifically, referring to FIG. 3, the column of coils designated by numeral 65 signifies the end coils of the various rows of coils 12*e*, 12*f* and 12*g* illustrated in FIG. 3. Referring to those end coils, such as end coil 67, the body 25 of the coil spirals downwardly from upper or top face surface 28*a* toward the lower or bottom face surface 28*b* of the innerspring structure. Proximate the face surface 28*b*, the coil straightens to form a short linear portion 69. If the coil was formed similarly to adjacent coils, the straight linear portion would essentially be the second linear portion 36 of the coil, which would not be engaged with the helical lacing structure 14. However, in accordance with another aspect of the present invention, a nipple 70 is formed which extends outwardly from the center axis X of the coil 67 and is configured to be captured with one or more turns of the helical lacing structure 14. From the nipple 70, the head 26 of the coil 67 extends generally away from the nipple 70 to form the first linear portion 32 opposite the nipple. The nipple 70 is engaged by the helical lacing structure 14 and the first linear portion 32 is also engaged by the helical lacing structure 14 or may be clipped to a peripheral support wire 16. In that way, the end coils 65 of the rows of coils in the innerspring structure 10 are secured on both sides, as opposed to only one side within the rest of the row, as illustrated in FIG. 3. Securing the heads 26 of the end coils 65 on both sides ensures a more durable innerspring structure 10.

While a helical lacing structure 14 is shown for coupling rows of coils together, other securing structures, such as clips, might be utilized to replace the helical lacing structures 14.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. An innerspring structure for a mattress comprising:

a row of outer coils, the row being formed from a continuous piece of wire with the adjacent coils of the row interconnected with interconnection segments;

a row of inner coils, the row being formed from a continuous piece of wire with the adjacent coils of the row interconnected with interconnection segments;

said interconnection segments of said rows of coils forming adjacent coil heads for pairs of adjacent coils and each coil head including a first linear portion disposed generally parallel to the row of coils;

the row of inner coils being positioned together and generally coaxially with the row of outer coils for forming a row of reinforced coil units;

a helical lacing structure extending along the row of reinforced coil units and winding around portions of the inner and outer coils of the row to couple the coils together into the reinforced coil units, the first linear portions of the coaxial coils in the row forming the reinforced coil units configured for being captured with at least approximately three loops of the helical lacing structure for further forming the row of reinforced coil units.

2. The innerspring structure of claim 1 wherein said interconnection segments further comprise second linear portions disposed opposite said first linear portions being in the coil heads, the second linear portions inset in the coil heads with respect to said first linear portions so as to remain uncoupled from the helical lacing structure.

3. The innerspring structure of claim 2 wherein said linear portion of a coil is positioned slightly vertically below said first linear portion in the coil head.

4. The innerspring structure of claim 1 wherein each of said interconnection segments further comprises a spanning portion extending between the respective first linear portions of a pair of adjacent coils to couple the first linear portions together, the spanning portion extending generally perpendicular to said first linear portions.

5. The innerspring structure of claim 1 wherein one of said rows of coils includes an end coil with an end head, a portion of the end head formed by the interconnection segment including a nipple formed to extend outwardly from the end coil axis opposite the first linear portion of the end head to be captured by the helical lacing structure for securing the end coil at two sides of the end head.

6. The innerspring structure of claim 1 wherein the first linear portions of the adjacent coil heads of adjacent coils are positioned generally on opposite sides of the adjacent coil heads such that each coil of a pair of adjacent coils is captured by a helical lacing structure on opposite sides of the row of coils.

7. The innerspring structure of claim 1 further comprising a plurality of rows of one of the inner and outer coils, the rows of coils coupled to the row of reinforced coil units with helical lacing structures.

8. An innerspring structure for a mattress comprising:

a row of outer coils, the row being formed from a continuous piece of wire with the adjacent coils of the row interconnected with interconnection segments;

a row of inner coils, the row being formed from a continuous piece of wire with the adjacent coils of the row interconnected with interconnection segments;

said interconnection segments of said rows of coils forming adjacent coil heads for pairs of adjacent coils and each coil head including a first linear portion disposed generally parallel to the row of coils;

the row of inner coils being positioned together and generally coaxially with the row of outer coils for forming a row of reinforced coil units;

a helical lacing structure extending along the row of reinforced coil units and winding around portions of the inner and outer coils of the row to couple the coils together into the reinforced coil units, the first linear portions of the coaxial coils in the row forming the reinforced coil units configured for being captured by the helical lacing structure for further forming the row of reinforced coil units.

9. The innerspring structure of claim 8 further comprising a plurality of rows of one of the inner and outer coils, the rows of coils coupled to the row of reinforced coil units with helical lacing structures.

10. The innerspring structure of claim 8 wherein each of said interconnection segments further comprises a spanning portion extending between the first linear portions of a pair of adjacent coils to couple the first linear portions together.

11. The innerspring structure of claim 8 wherein one of said rows of coils includes an end coil with an end head, a portion of the end head formed by the interconnection segment including a nipple formed to extend outwardly from the end coil axis opposite the first linear portion of the end head for securing the end coil at two sides of the end head.

12. The innerspring structure of claim 8 wherein the first linear portions of the adjacent coil heads of adjacent coils are positioned generally on opposite sides of the adjacent coil heads such that each coil of a pair of adjacent coils is captured by a helical lacing structure on opposite sides of the row of coils.

13. A spring structure for use within an innerspring structure, the spring structure comprising:

at least one pair of adjacent coils formed from a continuous piece of wire;

an interconnection segment connecting the pair of coils at an end of the coils;

said interconnection segment forming adjacent coil heads for the pair of adjacent coils and each coil head including a first linear portion, the first linear portions of adjacent coil heads disposed generally parallel each other;

the first linear portions configured for being captured by securing structures so that the pair of coils may be secured within an innerspring structure;

said interconnection segment forming a spanning portion extending between the pair of first linear portions to couple the first linear portions together, the spanning portion extending generally perpendicularly to said first linear portions.

14. The spring structure of claim 13 wherein said interconnection segment further comprises second linear portions disposed opposite said first linear portions being in the coil heads, the second linear portions inset in the coil heads with respect to said first linear portions so as to remain uncoupled from a securing structure.

15. The spring structure of claim 14 wherein said second linear portion of a coil is positioned slightly vertically below said first linear portion in the coil head.

16. The spring structure of claim 13 further comprising helical lacing structures winding around a portion of the coil heads, the helical lacing structures capturing the first linear portions of the coils with a plurality of loops such that the pair of coils may be secured within an innerspring structure.

17. The spring structure of claim 13 wherein one of said coils includes an end head, a portion of the end head including a nipple formed opposite to said first linear portion to be captured by a securing structure for securing the end coil at two sides of the end head.

* * * * *

UNITED STATES PATENT AND TRADEMARK OFFICE

CERTIFICATE OF CORRECTION

PATENT NO. : 6,149,143 
DATED : November 21, 2000
INVENTOR(S) : Darrell Richmond, Terry Aronson, Thomas J. Wells and Franklin H. Rawlings It is certified that error appears in the above-identified patent and that said Letters Patent is hereby corrected as shown below:

Column 1,
Lines 9 and 10, delete "Units," and insert -- Units," --.
Lines 15-16, add quotation marks before and after "Mattress Innerspring Structure Having Coaxial Coil Units,".

Column 2,
Line 37, delete "it" and insert -- It --.

Column 4,
Line 19, delete "DRAWING" and insert -- DRAWINGS --.
Line 30, insert "a" after "is".

Column 6,
Line 33, insert "." after together.

Column 8,
Line 67, delete "of course" and insert -- Of course --.

Column 10,
Line 27, delete "aligned" and insert -- aligned. --.
Line 28, delete initial ".".
Line 66, delete first occurrence of the word "fit".

Column 11,
Line 28, delete "may not both be above the heads 26b, 26b´".

UNITED STATES PATENT AND TRADEMARK OFFICE

CERTIFICATE OF CORRECTION

PATENT NO. : 6,149,143 
DATED : November 21, 2000
INVENTOR(S) : Darrell Richmond, Terry Aronson, Thomas J. Wells and Franklin H. Rawlings It is certified that error appears in the above-identified patent and that said Letters Patent is hereby corrected as shown below:

Column 12,
Line 15, delete "applicant's" and insert -- applicants' --.

Column 14,
Line 26, delete "being".
Line 27, insert "being" after the word "portions".

Signed and Sealed this

Fifth Day of February, 2002

*Attest:*

*Attesting Officer*

JAMES E. ROGAN
*Director of the United States Patent and Trademark Office*